US005477626A

United States Patent [19]

Kwon

[11] Patent Number: 5,477,626

[45] Date of Patent: Dec. 26, 1995

[54] MULTIFUNCTIONAL SHOE

[76] Inventor: Joong T. Kwon, Mora-Dong, Woosung Apt. 1-1502, Book-Ku, Pusan, Rep. of Korea

[21] Appl. No.: 268,977

[22] Filed: Jun. 30, 1994

[30] Foreign Application Priority Data

Mar. 10, 1994 [KR] Rep. of Korea ..... UM94-4895

[51] Int. Cl.[6] ..... A43B 7/06; A43B 13/20

[52] U.S. Cl. ..... 36/3 B; 36/3 R

[58] Field of Search ..... 36/3 R, 3 B, 29, 36/35 B

[56] References Cited

U.S. PATENT DOCUMENTS

| | | | |
|---|---|---|---|
| 1,660,698 | 2/1928 | Williams, Sr. | 36/3 R |
| 1,711,302 | 4/1929 | Belpedio | 36/35 B |
| 4,610,099 | 9/1986 | Signori | 36/3 B |
| 4,654,982 | 4/1987 | Lee | 36/3 R |
| 4,845,861 | 7/1989 | Moumdjian | 36/29 |
| 5,025,575 | 6/1991 | Lakic | 36/3 B |
| 5,042,176 | 8/1991 | Rudy | 36/29 |
| 5,195,254 | 3/1993 | Tyng | 36/3 B |
| 5,195,257 | 3/1993 | Holcomb et al. | 36/3 B |
| 5,228,156 | 7/1993 | Wang | 36/35 B |
| 5,341,581 | 8/1994 | Huang | 36/3 B |

FOREIGN PATENT DOCUMENTS

| | | | |
|---|---|---|---|
| 2262024 | 6/1993 | United Kingdom | 36/3 B |

*Primary Examiner*—Steven N. Meyers
*Attorney, Agent, or Firm*—Birch, Stewart, Kolasch & Birch

[57] ABSTRACT

A multifunctional shoe having a self-ventilating system and a shock-absorbing system, includes a ring-shaped heel chamber member disposed in a heel portion of an outsole of the shoe and a squeezing chamber member disposed in the ring-shaped heel chamber member, the heel chamber member and the squeezing chamber member forming a composite structure, whereby the multifunctional shoe can be effectively self-ventilated and shock-absorbed as well as the air powerfulness of the heel chamber can be controlled by a separate air pumping device.

2 Claims, 3 Drawing Sheets

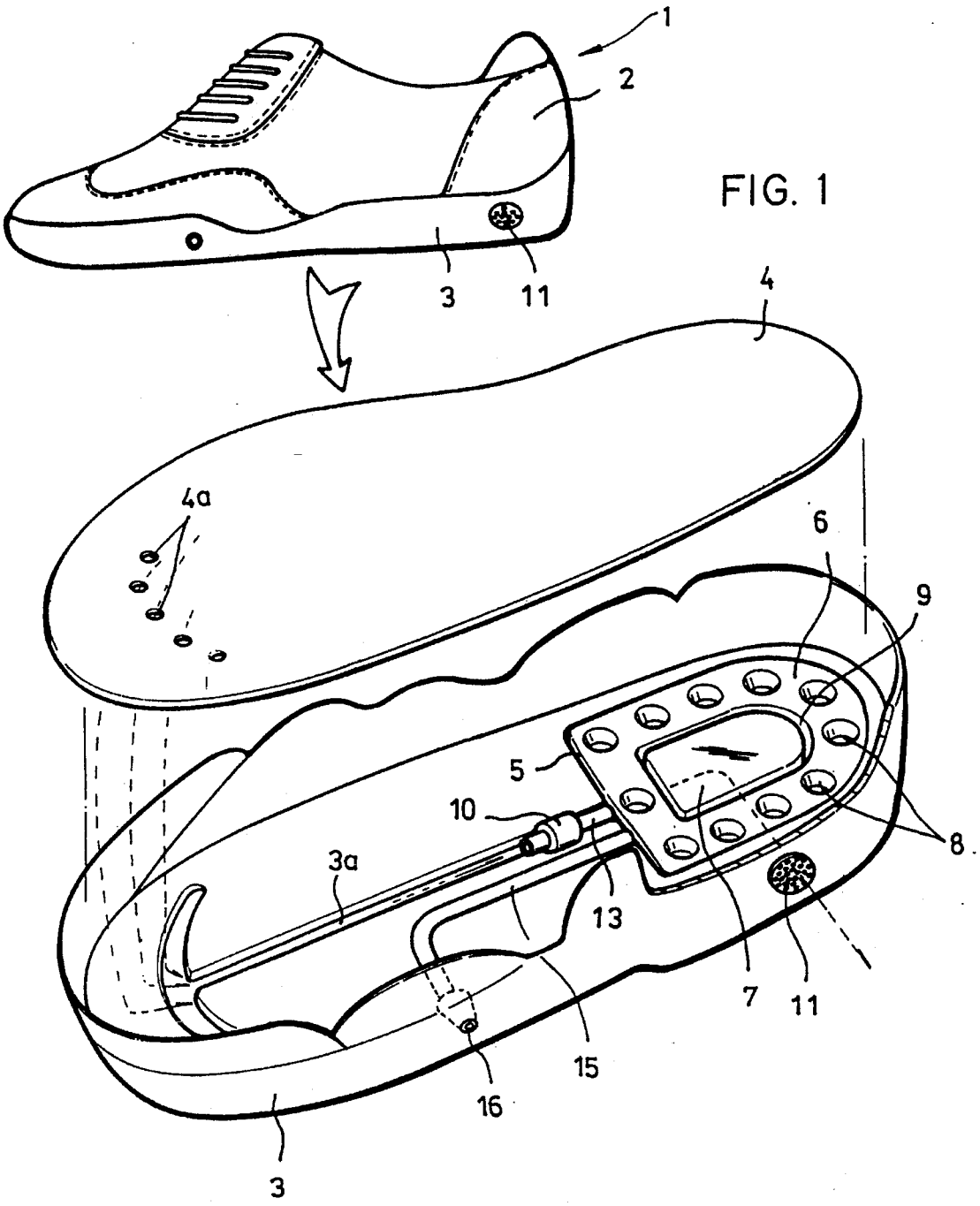
FIG. 1
FIG. 3
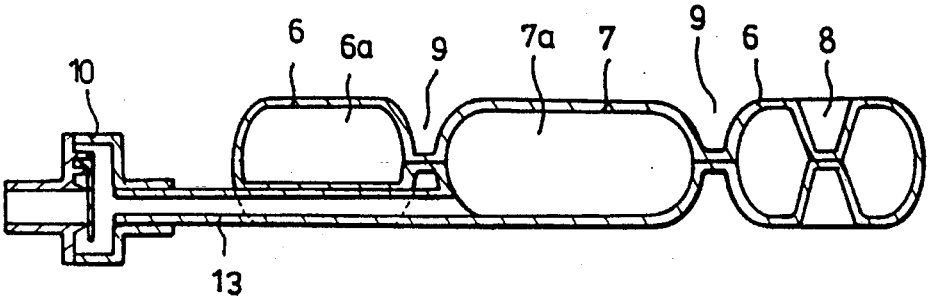

MULTIFUNCTIONAL SHOE

BACKGROUND OF THE INVENTION

1. Field of the Invention

The present invention relates to an improved multifunctional shoe and more particularly, to a shoe which includes a self, ventilation system and an adjustable shock-absorbing system disposed therein, whereby the shoe can be continuously ventilated and a shoe wearer can control the shock-absorbing power of the shoe.

2. Description of Related Art

Various types of self-ventilating shoes and shock-absorbing shoes are well known in the art. Presently known soles for shoes comprise elastomeric and resilient pads which are made of soft material such as a sponge or rubber and contain a plurality of holes in the sole and in the heel of the shoe in order to increase foot comfort. In such types of soles, it is very difficult to remove moisture and the odor produced as a result of moisture which collects in the shoe due to foot perspiration and poor shoe ventilation. Since most people use their shoes for a long period of time, it is essential to properly maintain and ventilate the shoes in order to avoid foot diseases such as, for example, water eczema.

However, generally, the self-ventilating system and the shock-absorbing system are not combined together in a shoe. Also, such self-ventilating shoes contain a number of disadvantages such as, for example, the shoes cannot be maintained to ventilate for a long period of time and a valve cover thereof can be easily separated from a body member thereof. Furthermore, it is very difficult to manufacture. The shock-absorbing shoes have a number of disadvantages such as, for example, they cannot control the shock-absorbing power on demand.

SUMMARY OF THE INVENTION

Accordingly, it is an object of the present invention to provide an improved multifunctional shoe, which eliminates the above problems encountered with conventional self-ventilating shoes.

Another object of the present invention is to provide a shoe ventilation system which is effective in providing a circulation of air within the shoe while it is in use and a shoe shock-absorbing system which can be controlled on demand.

A further object of the present invention is to provide a shoe which comprises a squeezing chamber disposed in the heel portion of the shoe for functioning as a self-ventilation mechanism and a heel chamber member surrounding the squeezing chamber for functioning as a shock-absorbing member, the squeezing chamber and heel chamber member forming a composite structure.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 1 is an exploded perspective view of the multifunctional shoe according to the present invention;

FIG. 3 is a sectional view of FIG. 2, taken along line A—A;

DESCRIPTION OF THE PREFERRED EMBODIMENTS

Figure 2:
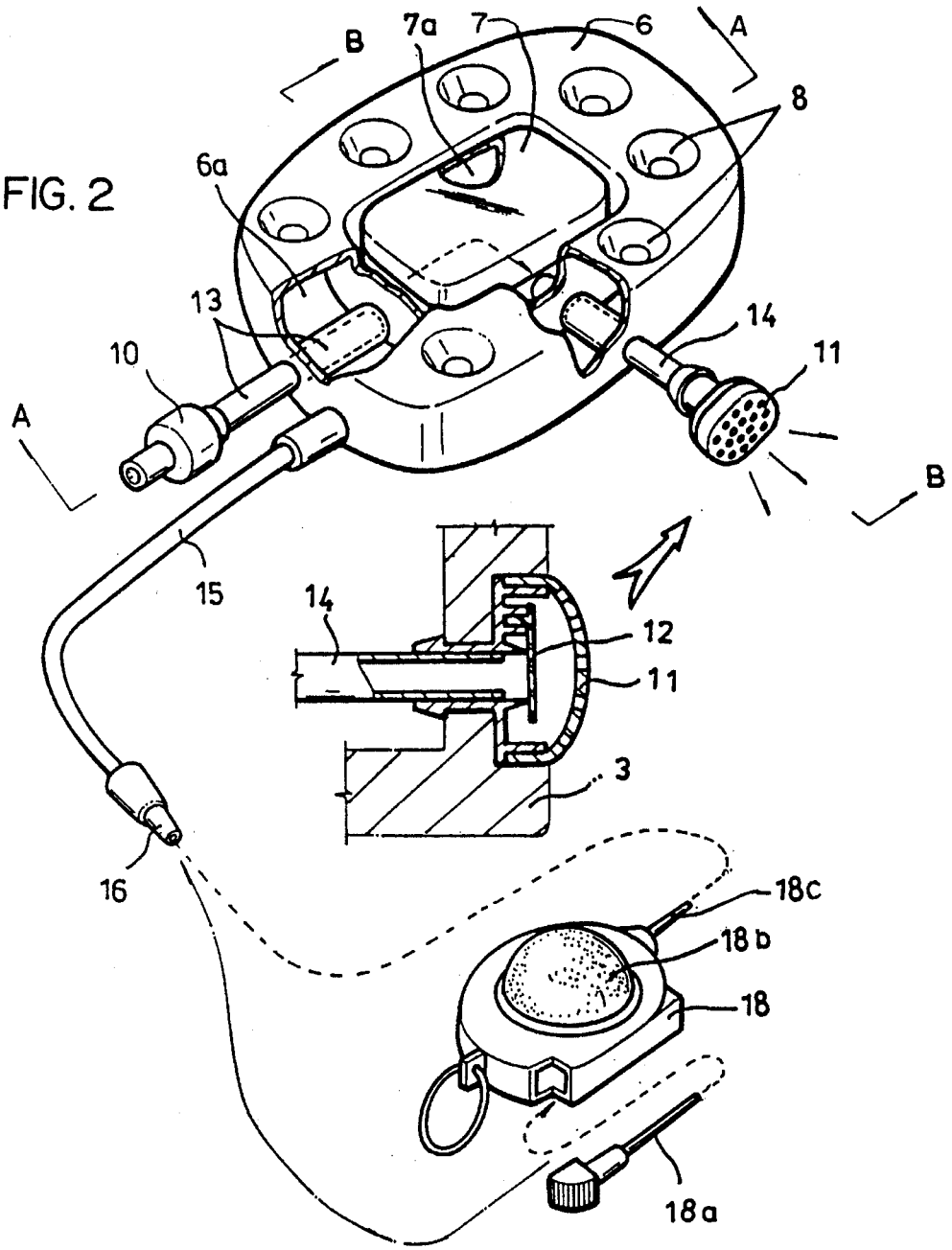
FIG. 2 is a perspective view of a heel chamber member including a squeezing chamber operatively connected to an air pump according to the present invention.

Referring now in detail to the drawings for the purpose of illustrating preferred embodiments of the present invention, the improved multifunctional shoe as shown in FIGS. 1, 2, 3, and 4 comprises a heel chamber member 6 built in the receiving area 5 of the heel portion of an outsole 3 of a shoe 1 and an air pumping member operatively assembled with the heel chamber member 6 through air inlet and outlet pipe 15 on demand.

Figure 4:
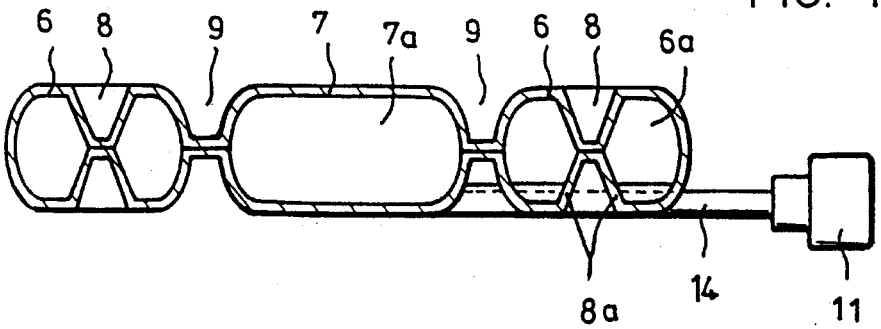
FIG. 4 is a sectional view of FIG. 2, taken along line B—B.

The heel chamber member 6 includes a squeezing chamber 7 disposed in the center thereof, and a T-shaped air discharging channel **3*a* communicated therewith and disposed in the bottom surface of the outsole 3. A plurality of circular configured high frequency welding members 8 are disposed on the heel chamber member, so that a plurality of H-shaped supporting members 8*a* are located in a ring-shaped heel chamber space 6*a* for supporting the heel chamber member 6 as shown in FIGS. 3 and 4. Also, the heel chamber member 6 is separated from the squeezing chamber 7 by a circular groove 9**.

The air inlet and outlet pipe 15 is built in the outsole 3 and an end nozzle 16 of the air inlet and outlet pipe 15 is located on one side wall of the outsole 3 (FIG. 1). As shown in FIG. 2, the air pumping member 18 contains a pressing rubber tube **18*b* and an air pouring opening 18*c*, and an air discharging pin 18*a*. Therefore, after the air pouring opening is inserted into the end nozzle 16 of air pipe 15, the air is pumped by pressing the pressing rubber tube 18*b*. In order for the air in the heel chamber member 6 to be discharged to the atmosphere, the end nozzle 16 is pricked with the air discharging pin 18*a***.

As shown in FIGS. 1 and 2, the squeezing chamber 7 is provided with a waste air inlet tube 13 having a check valve 10 communicated with air discharging channel **3*a*, and an air outlet tube 14 communicated therewith for discharging the waste air to the atmosphere. The air outlet tube 14 has a net cover 11 and an air discharging valve 12 for operating in an on-position and simultaneously the check valve 10 operates in an off-position so as to expel the waste air in the interior of the squeezing chamber 7** to the atmosphere when the wearer of the shoe places the heel thereof against the ground in taking a step.

The air discharging channel **3*a* having the T-shaped configuration, is provided with a plurality of air apertures 4*a* disposed on the toe area of an inner sole 4. The air apertures 4*a* are connected to the upper part of the T-shaped air discharging channel 3*a*(FIG. 1). The waste air in the shoe is to be expelled to the air discharging channel 3*a* through the plurality of air apertures 4***a* when the foot is raised after the foot places the heel of the shoe 1. Because a vacuum is created by expansion of the interior of the squeezing chamber 7, whereby the air discharging valve 12 is closed and the waste air is displaced in the interior of the squeezing chamber 7 through the check valve 10 in the open position.

Figure 5:
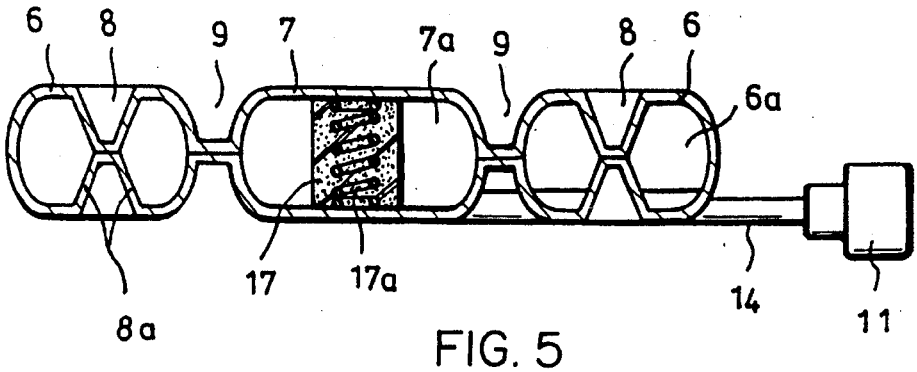
FIG. 5 is a sectional view of an additional embodiment of FIG. 4.

Referring in detail to FIG. 5, there is illustrated an additional embodiment of a heel chamber member 6 in accordance with the present invention. The squeezing chamber 7 includes a squeezing space 7*a* containing a cushion rubber bag 17 disposed therein for increasing suction of waste air from the interior of the shoe 1. The cushion rubber bag 17 includes a spring 17*a*.

Figure 6:
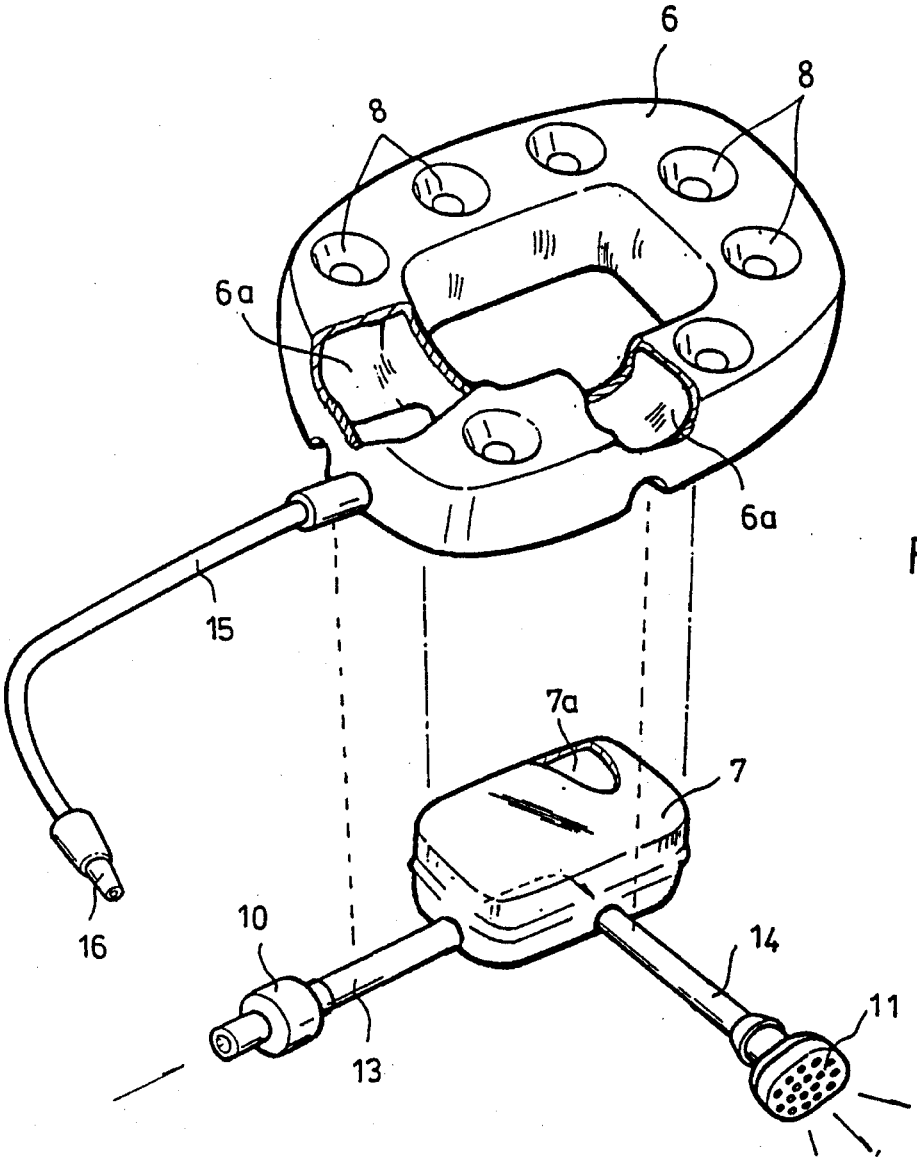
FIG. 6 is an exploded perspective view of a third embodiment of the heel chamber member and the squeezing chamber according to the present invention.

Referring in detail to FIG. 6, there is illustrated a third embodiment of a heel chamber member 6 in accordance with the present invention. The squeezing chamber 7 is necessarily fully separated from the heel chamber member 6. However, the heel chamber member 6 and the squeezing chamber 7 are made of polyurethane sheets and the like so that the heel chamber member 6 and squeezing chamber 7 form a composite structure by welding through the high frequency welding procedure.

The multifunctional shoe according to the present invention operates as follows. When the wearer of the multifunctional shoe places the heel thereof against the ground in taking a step, the squeezing chamber 7 disposed in the heel portion of the insole 3 is compressed and the waste air delivered from the air discharging channel 3*a* is expelled to the atmosphere through the net cover 11 of the air discharging valve 12.

At this time, the air discharging valve 12 is opened by the air force when the waste air is being forced out of the squeezing chamber 7 and simultaneously the check valve 10 is in the closed position. Accordingly, as the foot is raised, a vacuum is created by the expansion of the interior of the squeezing chamber 7. At this time, the air discharging valve 12 is closed and the check valve 10 is open, whereby the waste air in the shoe 1 is displaced in the interior of the squeezing chamber 7 through the plurality of insole apertures 4*a* and the T-shaped air discharging channel 3*a*

Accordingly, the fresh air is displaced in the interior of the shoe 1. Thus, the flow of fresh air into the interior of the shoe 1 from the atmosphere with every step taken by the wearer functions to keep the foot dry and cool, thereby inhibiting the formation of foot fungi and other diseases, because the self-ventilation system of the present invention functions to suction the waste air from inside the shoe so as to expel it to the atmosphere.

Also, the heel chamber member 6 having a plurality of the H-shaped supports 8*a* provides a cushioning effect to the wearer which reduces the amount of the shock through the H-shaped supports 8*a* and the cushion rubber bag 17 containing the spring 17*a* which is produced by walking.

The powerfulness of the heel chamber member 6 can be controlled by adding or reducing air through the air pumping member 18 or the air discharging pin 18*a*. That is, if the desired shock-absorbing powerfulness increases such as for athletic sports, jogging, etc., the air pouring opening 18*c* of the air pumping member 18 is inserted into the end nozzle 16 and the air pumping rubber tube 18*b* is pressed. Therefore, the heel chamber spaces 6*a* are filled up with air.

On the contrary, if the desired shock-absorbing power is decreased such as when walking, mountain-climbing, etc., the air discharging pin 18*a* of the air pumping member 18 is inserted into the end nozzle 16 so as to expel the air from the heel chamber spaces 6*a*.

The squeezing chamber 7 and the heel chamber member 6 can be made of transparent material for increasing visual ornament.

The invention being thus described, it will be obvious that the same may be varied in many ways. Such variations are not to be regarded as a departure from the spirit and scope of the invention, and all such modifications as would be obvious to one skilled in the art are included to be within the scope of the following claims.

What is claimed is:

1. A multifunctional self-ventilating and shock-absorbing shoe comprising:

an outsole having a hollow portion thereof;

a shock-absorbing system including a heel chamber member disposed in said hollow portion of said-outsole, said heel chamber member having a ring configuration and a plurality of support portions disposed within the heel chamber including a plurality of bowl-shaped grooves which are symmetrically disposed on top and bottom thereof;

a heel chamber air inlet and outlet tube communicating with said heel chamber member for adding or discharging air by a separate air pumping device; and a self-ventilating system including a squeezing chamber member forming a composite structure With such said heel chamber member and including an are discharging channel and a waste air inlet tube with a check valve and a squeezing chamber air outlet tube with an air discharging valve for replacing fresh air in the interior of the shoe, wherein said squeezing chamber member is disposed in a center of said ring configuration of the heel chamber member, said air discharging channel has a T-shaped configuration, an upper portion of said air discharging channel operatively connected to a plurality of apertures disposed on an upper portion of an inner sole, whereby when pressure is applied to the squeezing chamber member, air is effectively expelled from the squeezing chamber member through said squeezing chamber air outlet tube and when the pressure is released, waste air is effectively drawn into the squeezing chamber member through said waste air inlet tube so as to suction waste air from the shoe, wherein a force applied to a heel portion of the shoe can be effectively absorbed, and the air pressure of the heel chamber member can be effectively controlled by an air pumping member;

wherein said outsole is provided with said squeezing chamber air outlet tube and an end nozzle built in one side wall of a heel portion and a forward portion, respectively.

2. The multifunctional shoe of claim 1, wherein said squeezing chamber air outlet tube includes a net cover for easily expelling waste air therethrough.

* * * * *